114-242 MECH SR
6/26/84 XR 4,455,961

United States Patent [19]
Hansen et al.

[11] 4,455,961
[45] Jun. 26, 1984

[54] OVERBOARDING FIXTURE

[75] Inventors: Charles E. Hansen, Alpine; Paul A. Hanson, La Mesa, both of Calif.

[73] Assignee: The United States of America as represented by the Secretary of the Navy, Washington, D.C.

[21] Appl. No.: 391,900

[22] Filed: Jun. 25, 1982

[51] Int. Cl.[3] ..... B63B 21/16
[52] U.S. Cl. ..... 114/254; 242/157.1; 254/331; 114/242; 114/253
[58] Field of Search ..... 114/243, 244, 245, 254; 242/158, 158 B, 158 R, 117, 157.1; 254/336, 331, 334, 335, 264, 389, 395; 226/196, 199

[56] References Cited

U.S. PATENT DOCUMENTS

| | | | |
|---|---|---|---|
| 2,016,755 | 10/1935 | Spracher | 242/157 |
| 2,340,436 | 2/1944 | Stone | 242/158 B |
| 2,478,486 | 8/1949 | Holleron | 254/190 |
| 2,660,382 | 11/1953 | Wilson | 242/117 |
| 3,051,602 | 8/1962 | Schairbaum | 154/54 |
| 3,456,899 | 7/1969 | Smith | 242/158 R |
| 3,544,035 | 12/1970 | Woolever | 242/158 |
| 3,836,086 | 9/1974 | Kodama | 242/34.5 R |
| 4,087,060 | 5/1978 | Laky | 242/158 R |

*Primary Examiner*—Trygve M. Blix
*Assistant Examiner*—Edwin L. Swinehart
*Attorney, Agent, or Firm*—Robert F. Beers; Ervin F. Johnston; Thomas Glenn Keough

[57] ABSTRACT

An improved fairlead reduces the problems associated with deploying and retrieving a towing cable and its interconnected elongate instrumentation array. A pair of parallel rollers orthogonally disposed to a storage winch reel are spaced apart to present a smooth, protuberance-free surface to accommodate the elongate instrumentation array. A shell coaxially disposed about each of the cylinders is rotated to cover the smooth protuberance-free surfaces and present a pair of abrasion-resistant surfaces when the towing cable is reeled in or payed out. Since it is likely that the abrasion-resistant surface might be scored by the towing cable, rotating the abrasion-resistant surfaces out of the way to expose the protuberance-free accommodating surfaces when the array goes through the fairlead helps reduce the possibility of damage of the elongate instrumentation array during deployment and recovery.

4 Claims, 6 Drawing Figures

FIG. 1
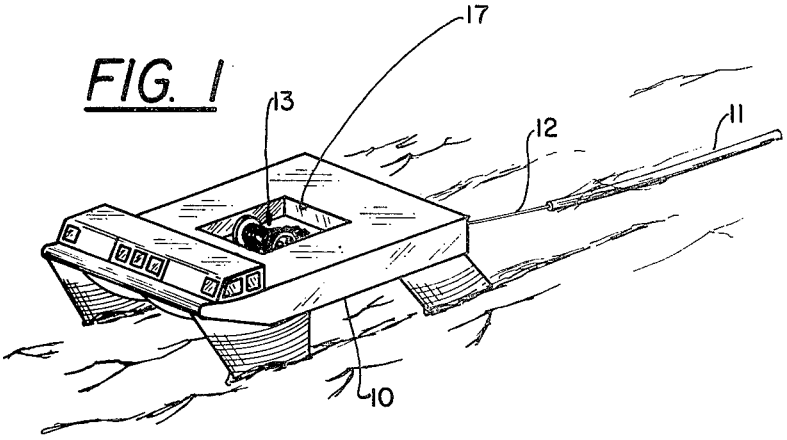
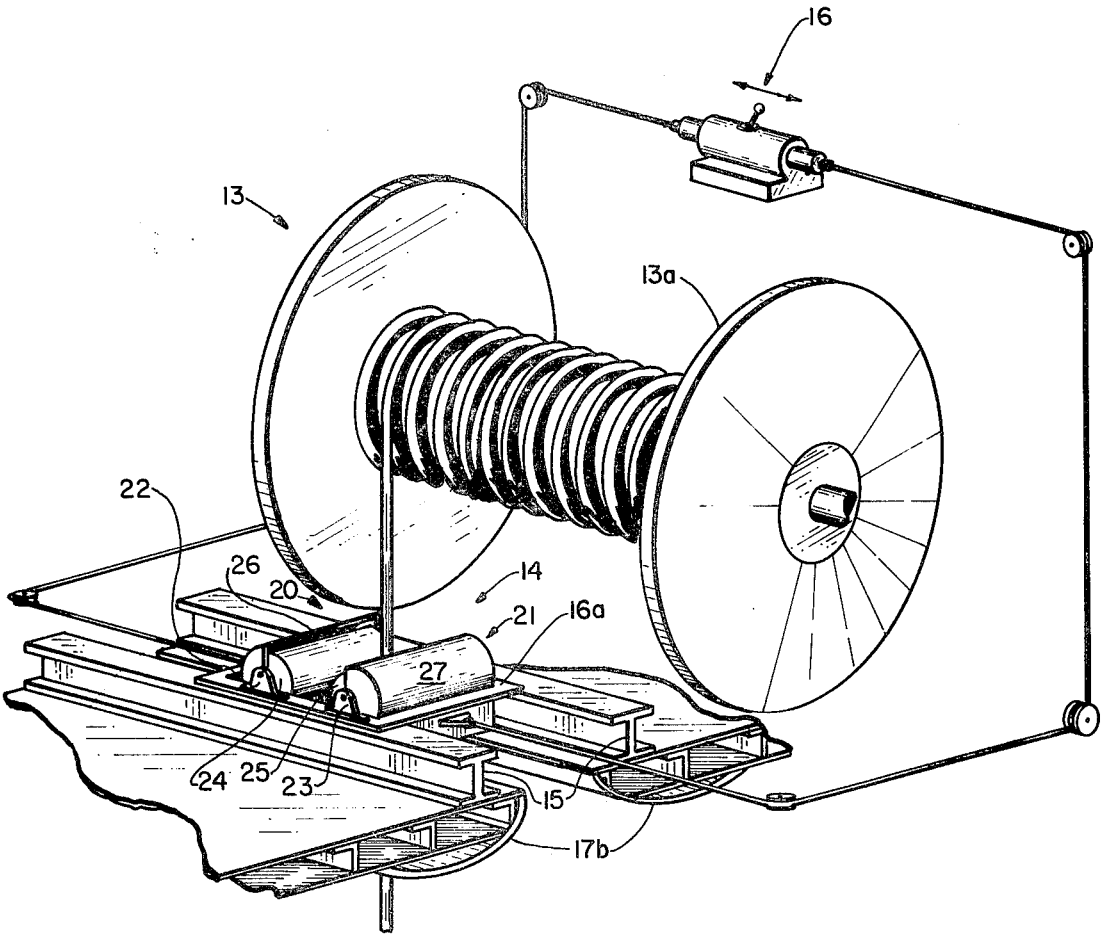
FIG. 2

OVERBOARDING FIXTURE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

A number of overboarding fixtures have evolved since the need for towing acoustic hydrophone arrays through the ocean became known. Several designs constrain the cable to undergo varying amounts of bending over short radii, increasing the tension with which the array is wrapped upon the winch reel, and offering the possibility of fouling, crushing, scoring, abrading, etc., and subsequent damage to the hydrophones.

An early design by J. H. Wilson and disclosed in U.S. Pat. No. 2,660,382 concerns a level winding device for winding a cable on a cable drum. A number of sheaves in a guide head receives a cable for assuring a level winding of the cable. This design is highly suited for winding a relatively heavy steel cable onto a drum and can sense and make allowances for stretched, thinner diametered cables.

The level winder of S. M. Stone et al in U.S. Pat. No. 2,340,436 guides the cable through a guide head to enable the winding of the cable on a drum. Reciprocal motion by the guide head along the drum axis maintains an effective leverage to guard against distortional strain of the cable load. Properly dimensioned sheaves receive and guide the cable during the winding operation and are capable of upward motion so that each succeeding layer can be wound.

Displacement of a carriage carrying a winch drum was relied upon by J. R. Smith et al in U.S. Pat. No. 3,456,899. Winding of a cable on a drum, perpendicular with respect to the drum axis, was even wound by a novel sensing and coupling. A tangle-free winding of a rod-like material about a reel relied on an improved electromechanical sensing device used to control the traverse movements of the carriage in accordance with a desired lag angle and a desired manner and rate of coiling of the rod-like material about the reel.

Although the afore-identified devices of the prior art all represent noteworthy advances in the state-of-the-art, it appears that one persistent, consistent problem remains. The conventional cable spooling techniques, particularly those associated with overboarding operations, have the problem that the armored tow cable tends to abrade and roughen the surfaces of the overboarding fixture, the fairlead structure, which consequently abrades and damages the elongate instrumentation array as it passes over the abraded and roughened surfaces.

Thus, there is a continuing need in the state-of-the-art for an overboarding fairlead having the capability to pass an abrasive towing cable and an elongate instrumentation array that does not damage the array.

SUMMARY OF THE INVENTION

The present invention is directed to providing an improvement for a fairlead apparatus for overboard launching and recovering of an elongate instrumentation array and towing cable from a winch reel. A fairlead providing means is orthogonally disposed adjacent the winch and has first bearing surfaces spaced apart to receive the towing cable and fabricated to present an abrasion-resistant surface. A second bearing surface is spaced apart to receive the elongate instrumentation array and is fabricated to present a protuberance-free surface to accommodate the elongate instrumentation array. The second bearing surfaces are exposed to accommodate the elongate instrumentation array when the first bearing surfaces have been oppositely rotationally displaced from their covering positions over the first bearing surfaces.

A prime object of the invention is to provide an improvement for a cable-instrumentation array overboarding fixture.

Another object of the invention is to provide an overboarding fixture designed to reduce the fixture-induced damage to an instrumentation array.

Still another object is to provide an overboarding fixture having the capability for separately accommodating a continuously extending towing cable and elongate instrumentation array to consequently avoid self-induced damage to the array.

Still another object of the invention is to provide an overboarding fixture orthogonally disposed with respect to a winch reel for reducing failure inducing strains.

Still another object is to provide a fairlead having parallel rollers mounting displaceable sleeves to continuously receive an elongate array and towing cable respectively.

These and other objects, advantages and novel features of the invention will become apparent from the following detailed description of the invention when considered in conjunction with the accompanying drawings.

BRIEF DESCRIPTION OF THE DRAWINGS

FIG. 1 is an isometric depiction of an oceanographic vessel towing an elongate instrumentation array via a towing cable.

FIG. 2 schematically depicts a mirror image orientation of the winch assembly and fairlead mechanism of FIG. 1.

DESCRIPTION OF THE PREFERRED EMBODIMENT

Referring now to FIG. 1 of the drawings, a surface craft 10 tows an elongate instrumentation array 11 through the water by means of a towing cable 12. The type surface craft shown is a semi-submerged ship, one of an evolving family of vessels that greatly reduces the effects of surface wave action and allows a "straight down" array deployment.

The instrumentation array is a number of hydrophones serially arranged and suitably connected for seismic exploration or monitoring of undersea sounds and can include other sensors depending on the type of data that is needed. The array is covered and protected by a flexible smooth sheath that is sensitive to impinging acoustic energy and reduces self-generated flow noise. The towing cable has a smaller diameter than the instrumentation array and is any one of a number of wire ropes that have a sufficient strength to tow the array. Several instrumentation arrays may be separated within the flexible sheath to, for example, vary the size of the acoustic aperture or provide a delay or separation for greater directional sensitivity.

The array and cable continuously extend and are stored on a winch reel assembly 13 carried on the support craft. The assembly is built along conventional lines in which a reel 13*a* is provided for storing a continuously wound cable and array. The driving motor, hydraulic or electromechanical controls and couplings are well within the state-of-the-art and further elaboration on this structure is felt unnecessary.

Figure 4:
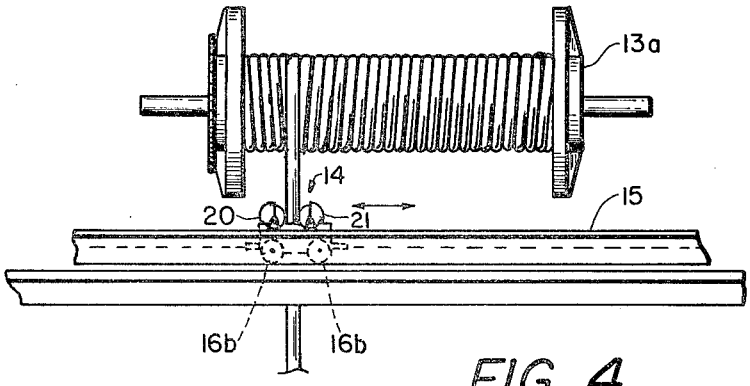
FIG. 4 shows an orthogonal orientation of the fairlead mechanism with respect to the winch reel.

The winch reel assembly is located on the deck of a ship or in a well 17 so that the cable and array are payed out and retrieved at a right angle to the reel, see FIGS. 2 and 4. This disposition of the cable and array from the drum has been found to reduce the unreasonable bends and consequent chafing and abrading of the array. Rounded surfaces 17*b* prevent damage to the array and cable.

A further reduction of destructive actions which may damage the array during launch and retrieval is attributed to a fairlead mechanism 14. The fairlead assembly is mounted on a pair of I-beam tracks 15 and is bidirectionally displaced along the tracks via a suitable control system 16. The control system, schematically depicted by a control box and interconnected cables, is a suitably fabricated mechanical, electromechanical, hydraulic, etc., assembly that is well established in the art to impart a controlled bidirectional displacement of the fairlead mechanism on the I-beam tracks. Manual or automatic servo devices which uniformly wind and unwind the cable and array on the drum are many and varied in design, for example, those mentioned above are advantageously employable without detracting or departing from the spirit and scope of this inventive concept.

Irrespective which level winding approach is selected, chafing and abrading are markedly reduced by inclusion of this discretely designed fairlead mechanism 14. The fairlead mechanism has an open square framework 16*a* that rests on I-beam tracks 15. Rollers 16*b* are provided, see FIG. 4, that permit relatively effortless bidirectional motion along the I-beam tracks.

Two guide elements 20 and 21 are each journaled in opposite sides of square framework 16*a*. The guide elements are mounted in journal mounts 22 and 23 a discrete distance apart to allow the passage of the cable or hydrophone array. Cylindrically shaped bearing surfaces 24 and 25 are journaled in journal mounts 22 and 23 and have a diametrical dimension to accommodate the diameter of the elongate instrumentation array therebetween. The exposed surfaces are fabricated from a polyurethane compound, Teflon or similar relatively friction-free, nonabrasive material that will not abrade or gouge the surface of the sheath covering the elongate instrumentation array.

A pair of shells 26 and 27 are journaled about the cylindrically shaped bearing surfaces 24 and 25, respectively. The separation of the outer surfaces of the shells is such as to receive the towing cable therebetween and the material from which the shells are fabricated is selected to present an abrasion-resistant surface to the towing cable as it is payed out and reeled in.

Figure 3A:
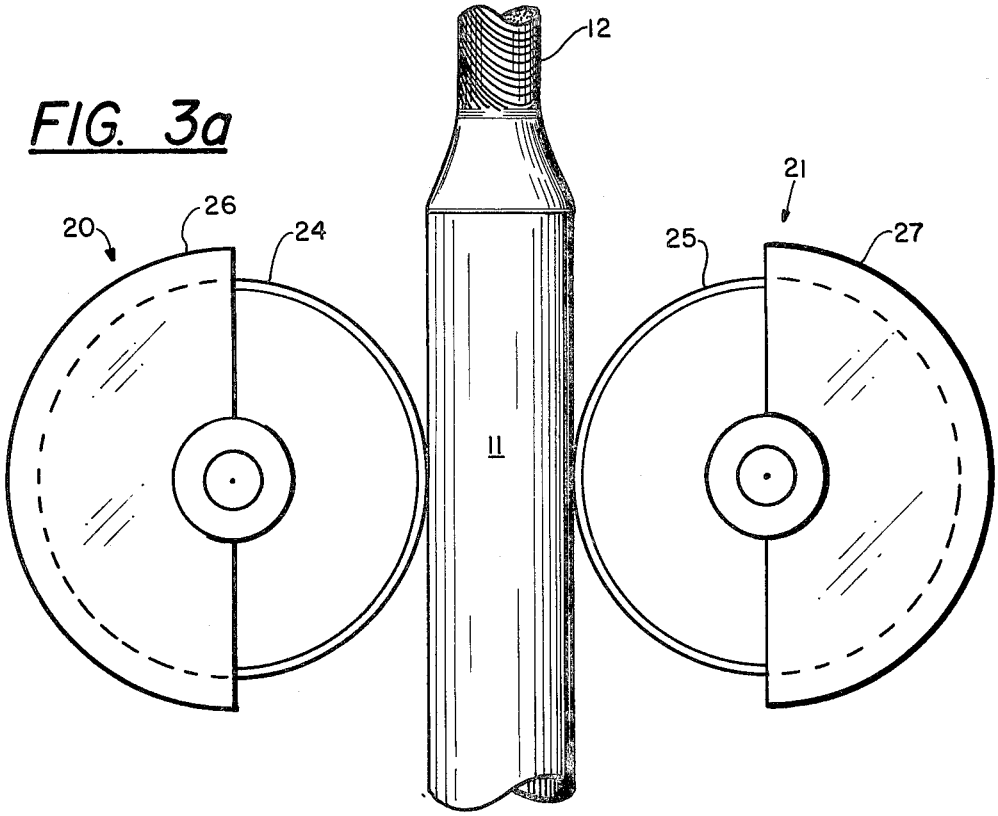
FIG. 3*a* and FIG. 3*b* are representations of the guide elements of the fairlead mechanism of FIG. 2.
Figure 3B:
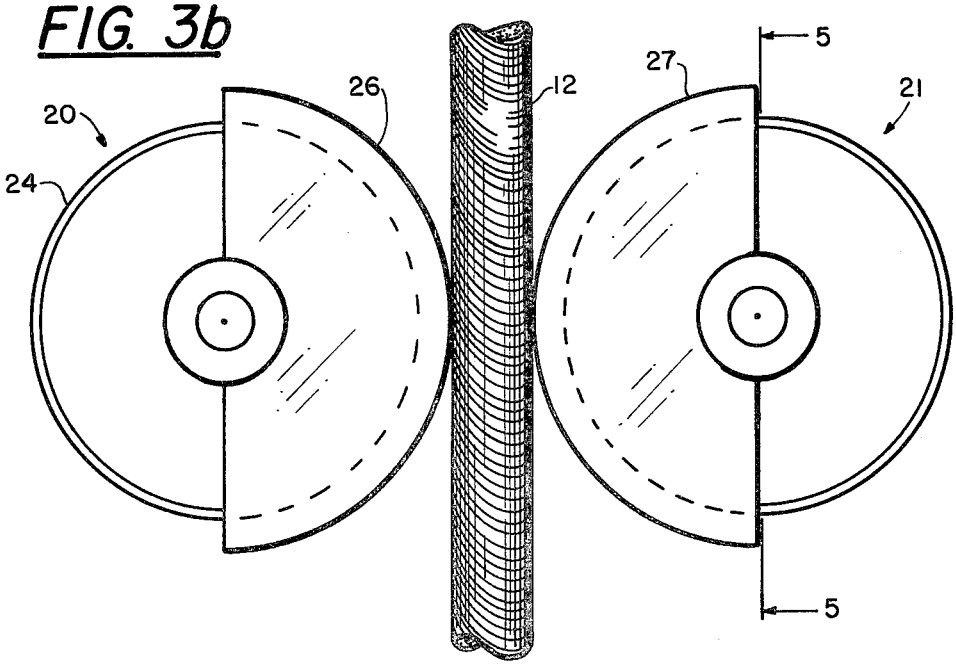

During launch or retrieval of the towing cable and array guide, elements 20 and 21 of fairlead mechanism 14 are suitably rotated to receive either the cable or the array, see FIG. 3*a* and 3*b*. Prior to deployment, shells 26 and 27 are rotated out of the way. Larger diametered elongate instrumentation array 11 passes between cylindrically shaped bearing surfaces 24 and 25 into the water. When towing cable 12 reaches the fairlead mechanism, shells 26 and 27 are either automatically or manually rotated about to abut the outer surface of the towing cable, see FIG. 3*b*. The abrasion-resistant surface of shells 26 and 27 may be scored to an acceptable degree; however, the smooth protuberance-free surface of cylindrically shaped bearing surfaces 24 and 25 accommodate the surface of elongate instrumentation array 11 without scoring or otherwise marring it.

Figure 5:
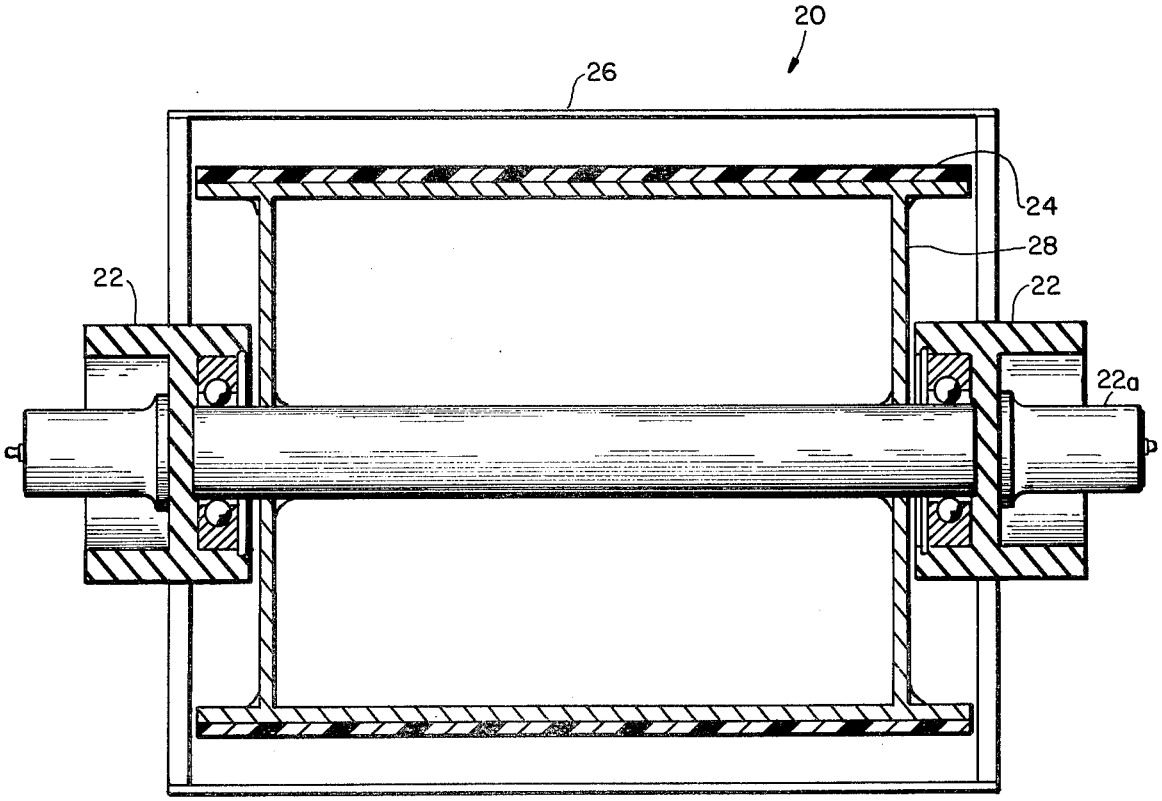
FIG. 5 depicts a cross-sectional representation of one of the guide elements of the fairlead structure.

Looking to FIG. 5, details of guide element 20 show a shaft 22*a* mounting cylindrically shaped bearing surface 24 and shell 26. The cylindrically shaped bearing surface in this embodiment is fitted about a can shaped support 28 secured to the shaft although it is understood that the surface 24 could be integral and solid throughout. The bearings on opposite ends of the shaft can be any of a host of designs to permit the selective covering and uncovering of the bearing surface 24 by its coaxially disposed shell 26.

Obviously many modifications and variations of the present invention are possible in the light of the above teachings. It is therefore to be understood that within the scope of the appended claims the invention may be practiced otherwise than as specifically described.

What is claimed is:

1. In an apparatus for the overboard launching and recovering of an elongate instrumentation array and towing cable from a winch reel, an improvement therefor is provided comprising:

means disposed adjacent the winch reel for providing a fairlead for the elongate instrumentation array and towing cable having first bearing surfaces spaced apart to receive the towing cable therebetween and fabricated to present an abrasion-resistant surface to the towing cable and second bearing surfaces spaced apart to receive the elongate instrumentation array and fabricated to present a smooth protuberance-free surface to accommodate the elongate instrumentation array, the first bearing surfaces and second bearing surfaces of the fairlead providing means are orthogonally disposed with respect to the winch reel to reduce bending of the towing cable and elongate instrumentation array and the second bearing surfaces are elongate rounded surfaces and the first bearing surfaces are elongate rounded surfaces located coaxially outwardly from the second bearing surfaces and are rotatably mounted to selectably expose the second bearing surfaces.

2. An improvement according to claim 1 in which the second bearing surfaces are cylindrically shaped having parallel axes and the first bearing surfaces are partial cylindrically shaped shells each coaxially journaled with a cylindrically shaped second bearing surface to selectively present a pair of exposed second bearing surfaces to accommodate the elongate instrumentation array as it passes therebetween and a pair of exposed first bearing surfaces to resist the abrasive effects of the towing cable as it passes therebetween.

3. An improvement according to claim 2 in which the second bearing surfaces are a pair of rollers each coaxially journaled within a semicylindrically shaped shell.

4. An improvement according to claim 2 in which the partial cylindrically shaped shells are configured to be oppositely rotated to expose their roller.

* * * * *